United States Patent [19]

DeLigt

[11] 4,038,122

[45] July 26, 1977

[54] METHOD AND APPARATUS FOR FABRICATING CORRUGATED BOARD FROM POLY-COATED PAPER

[75] Inventor: John DeLigt, Covington, Va.

[73] Assignee: Westvaco Corporation, New York, N.Y.

[21] Appl. No.: 593,833

[22] Filed: July 7, 1975

[51] Int. Cl.[2] ..... B31F 1/22

[52] U.S. Cl. ..... 156/210; 156/64; 156/205; 156/361; 156/378; 156/470

[58] Field of Search ..... 156/205, 207, 210, 470–472, 156/60, 350, 359, 361, 499

[56] References Cited

U.S. PATENT DOCUMENTS

| | | | |
|---|---|---|---|
| 3,004,880 | 10/1961 | Lord | 156/210 X |
| 3,886,019 | 5/1975 | Wilkinson et al. | 156/210 |
| 3,892,613 | 7/1975 | McDonald et al. | 156/210 |
| 3,920,496 | 11/1975 | Wilkinson et al. | 156/210 X |

*Primary Examiner*—David A. Simmons
*Attorney, Agent, or Firm*—W. Allen Marcontell; Richard L. Schmalz

[57] ABSTRACT

Corrugated board is formed by heating the plastic coated bonding surface of a liner web to a plasticizing temperature against the Teflon coated surface of a rotating heating drum and, while plasticized, fused against the flute crests of a corrugated medium web. The fusion bonded joints are set in the nip of a chilled pressure roll for stripping of the board unit from the corrugating roll surface. Speed of the single-face unit is primarily controlled as a function of the magnitude of angular wrap of the liner web about the heating drum. Temperature of the bonding surface of the liner web is sensed upon removal from the heating drum for the purpose of speed trim adjustment.

17 Claims, 2 Drawing Figures

METHOD AND APPARATUS FOR FABRICATING CORRUGATED BOARD FROM POLY-COATED PAPER

BACKGROUND OF THE INVENTION

1. Field Of The Invention

The present invention relates to the fabrication of corrugated board. Specifically, the present invention relates to a method and apparatus for bonding a polymer coated paper liner medium to a corrugated paper medium web.

2. Background Of The Invention

Over many years of use, corrugated paper board has proven to be extremely valuable in many, various uses due to the low cost and high strength to weight ratio. However, conventional paper board has also been limited to applications where the structural product fabricated therefrom will be protected from the invasion of moisture. This is due to the dramatic loss of strength caused by moisture absorption.

Efforts in the past to protect paper-base corrugated board from moisture invasions have included both wax and plastic coating of either the constituent webs prior to board fabrication or of a product assembled therefrom. Such past efforts have been less than satisfactory from several points of view.

As a water-proofing agent, wax has proven to lack the necessary strength and toughness. When applied to corrugated containers, handling abuses invariably cut or crack the wax coating at some point. If moisture is present, penetration will occur at the crack.

Great success has been achieved with polymer plastic as a moisture-proof cladding of a substrate paper web as described in U.S. Pat. Nos. 3,849,224 to H.L. Hintz et al. and 3,799,837 to O. Witnes et al.

Difficulties with commercial production techniques, however, have plagued the development of poly-coated paper as a corrugated board constituent.

Simultaneous with the development of water-proofing techniques for paper substrates, competitive manufacturing techniques for solid plastic web corrugated board have been developed. Although, the strength of solid plastic corrugated board is generally comparable to paper base board and completely unaffected by moisture, the relative cost is high and strength diminishes at higher ambient temperatures. In general, therefore, as a competitive alternative for most high moisture uses, solid plastic corrugated board presents a cost ceiling for plastic coated paper corrugated board.

The predominance of production for plastic coated paper corrugated board center about the single facing operation where a medium web is first formed into a corrugated continuum between the meshing nip of two corrugating rolls. Immediately thereafter while the corrugated medium is still held contiguous with the undulating surface of one of the corrugating roll pair, a liner web is bonded to the flute crests of the medium. This bonding occurs within 90° to 180° around the corrugating roll from the corrugating nip. Within an additional circumferential traverse of 90° to 180° about the corrugating roll, the resulting single-face board is stripped from the corrugating roll.

At high production rates and machine speeds, the time interim between joinder and stripping may be less than one second. This time interim is too short for the setting of most adhesives that are compatible with the plastic web coating. Accordingly, if either, the liner or the medium is plastic coated, a quick setting, hot melt adhesive must be used. However, hot melt adhesives are relatively very expensive for this application and, if used, the cost advantage of paper base board over solid plastic corrugated board is substantially lost.

As an alternative technique for bonding a liner web to a corrugated medium web on a single facer, the adjacent plastic coat of either web may be heat plasticized to a tacky consistency and then fused to the other web in the single facing nip. It is this technique to which the disclosure of U.S. Pat No. 3,811,987 to Wilkinson et al. is addressed. The Wilkinson et al patent uses an open flame to heat the adjacent coat of the liner web immediately prior to the single facing nip.

Experience with the Wilkinson et al. technique has been disappointing first, from the perspective of bond uniformity due to the non-uniform distribution of heat across the web from the burner head and, secondly, due to consequent pin holing in over-heated areas which destroys the moisture proof objective.

Although Wilkinson et al. were aware that the bond surface of the plastic coated liner could be sufficiently heated for plasticizing over a conventional, pre-heating drum, the technique was discounted by them because of web sticking to the drum surface. However, A.L. James in his U.S. Pat. Nos. 3,360,412 and 3,457,139 and his Dry Lamination article published in the July, 1970 issue of Paper, Film and Foil Converter, pages 29–31 taught that polymer plastic film could be plasticized over heated drums that were surface coated with a high temperature, non-sticking polytetrafluoroethylene resin plastic such as Teflon.

With these tools, the problems of fusing a board liner to the corrugated medium flute crests are largely reduced to heat transfer management coordinated with speed control.

In the past, uncoated liner and medium webs have been preheated over heating drums to a regulated temperature by controlling the degree of wrap that the web is allowed to traverse over the drum circumference. U.S. Pat. No. 3,004,880 to K.B. Lord teaches a technique whereby web temperature sensors control the angular position of automatically adjustable wrap control rollers. By this technique, the machine speed is set independently by the operator and the temperature regulating mechanism adjusts the degree of web wrap about the heating drum accordingly.

Because of the relatively narrow, tolerable "dead band" temperature for a plastic coated bonding surface, the Lord technique of temperature control tends to instability due to a continuous searching or hunting of the wrap control rollers for a correct setting under only moderately variable conditions.

Additionally, if a heater drum technique is used for plasticizing poly-coated paper at high production speeds, a relatively large traverse surface length is sometimes required to develop the necessary temperatures. One natural consequence of a large traverse surface length is a large diameter heater roll which is not only expensive to acquire but expensive to heat. Some advantage may be gained, however, by using a majority of the drum circumference as the traverse surface arc. However, this expedient is encumbered by the fact that the web supply point is fixed at a usually close proximity to the heating drum and when the heat transfer arc exceeds 180°, the web course will interfer with the heater drum structure.

SUMMARY OF THE INVENTION

The present invention embodies a plurality of innovations which, collectively, cooperate to yield a commercially successful production of paper base, poly-coated corrugated board. Such innovations comprise the use of compound, coordinated wrap control rollers for regulating the degree of web wrap over a large arc surface of a steam heated drum.

A Teflon coating of the pre-heating drum surface prevents sticking of the web coating to the drum surface.

To protect the moisture barrier integrity of the poly-coated corrugating medium upon forming by the corrugating roll nip, only hot, liquid water heat is transferred to the medium by the corrugating rolls.

Subsequent to the liner and medium web fusion nip, the fused, flute crest joints are chilled in the nip of a water cooled pressure roll to set the integrity of the joint for the present purpose of stripping the single-faced board from the corrugating roll surface. As the joint further cools, additional strength is gained.

Temperature of the liner web bonding surface is monitored by sensors for the purpose of machine speed control. Accordingly, heater drum wrap magnitude is manually controlled as an independent, operator variable and machine speed therefore becomes a dependent variable; primarily as a function of the wrap magnitude and secondarily as a function of web temperature. Surprisingly, little speed regulation hunting is experienced under this control scheme and the entire system quickly settles into a stable setting following a heater drum wrap adjustment.

BRIEF DESCRIPTION OF DRAWING

Relative to the drawing wherein like reference characters designate like or similar elements.

BRIEF DESCRIPTION OF THE PREFERRED EMBODIMENT

The present invention is directed particularly to the fabrication of corrugated board from polymer plastic coated paper web. Since the coating of either or both faces of a 0.008 to 0.010 inch (0.203mm to 0.254mm) thickness paper web with a 0.001 to 0.00075 inch (25.4$\mu$ m to 19.05$\mu$ m) surface laminae of a polymer plastic such as polyethylene, polybutylene, butyl rubber, polyisobutylene, polyvinylacetate, polyvinylbutyral, polymethylmethacrylate, polyvinlchloride and polyamides is well known to those of ordinary skill in the art, no further attention will be paid to those processes whereby such laminated webs are formed. However, it should be understood that the present invention also has utility in the fabrication of uncoated paper web for otherwise conventional corrugating processes.

Figure 1:
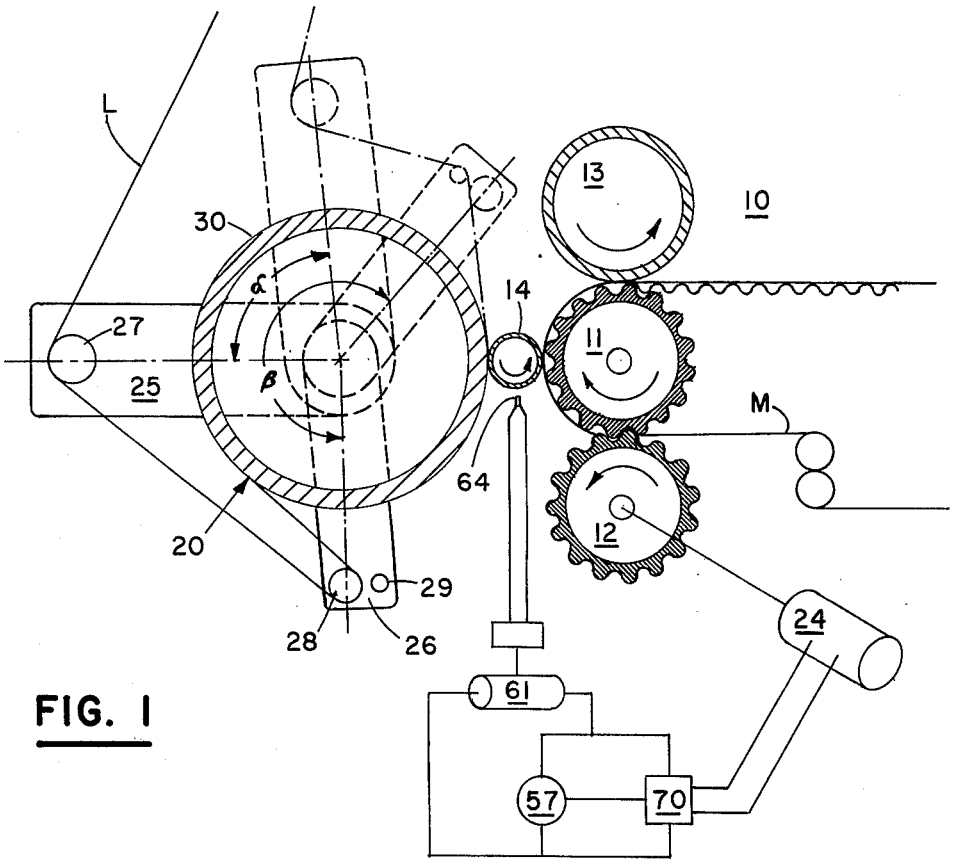
FIG. 1 is a schematic illustration of the present invention showing the web flow route through the apparatus.

Relative to FIG. 1, there is shown a single-face corrugating station 10 comprising two, hollow corrugating rolls 11, 12 and a hollow pressure roll 13.

Unconventional about the present single facer, is the use of hot water flow through the interior chambers of corrugating rolls 11 and 12 in lieu of steam.

Pressure roll 13 serves as a heat absorptive, chill roll and therefore, is provided with cold water circulation through the interior chamber thereof in lieu of conventional steam circulation.

Fusion roll 14 is hollow for the circulation of hot water therethrough.

Figure 2:
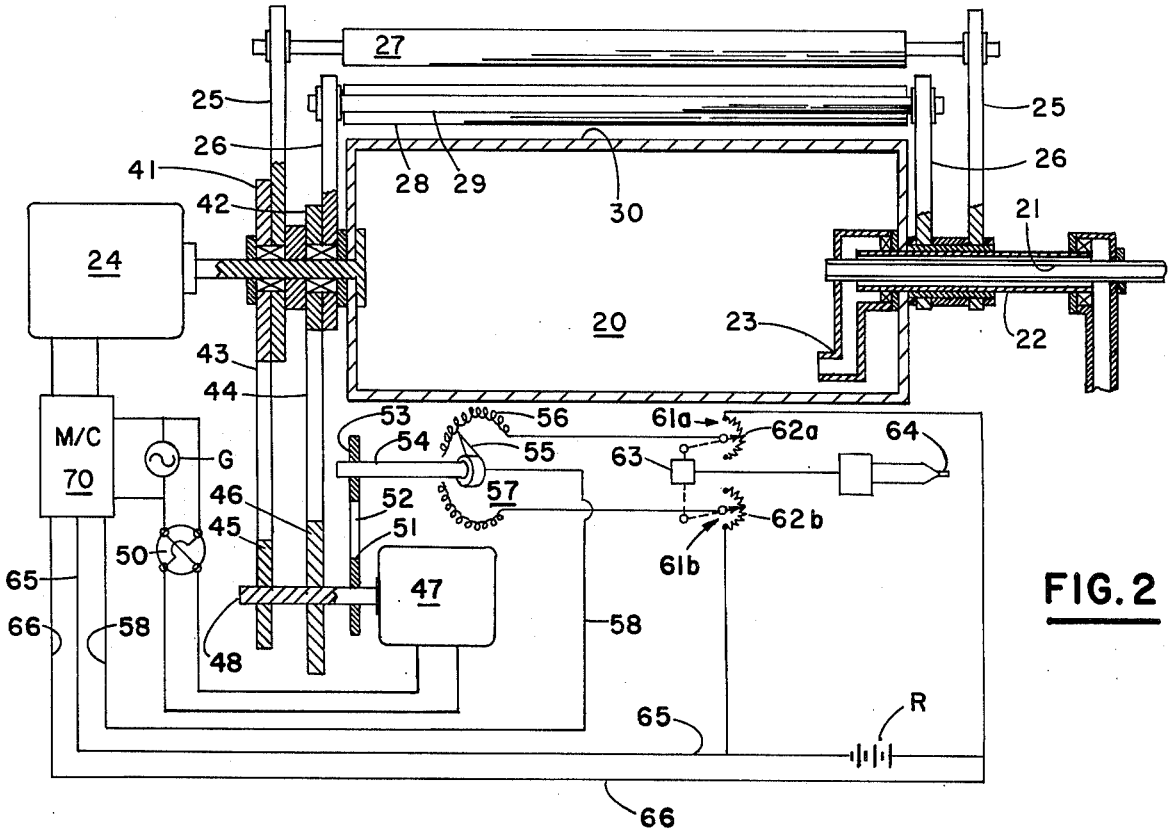
FIG. 2 is a sectional elevation of the present heater drum and wrap control apparatus.

Heater roll 20 is of relatively large diameter, approximately 36 diameter (385mm) and is hollow, as seen from FIG. 2, for the circulation of steam therethrough. Concentric steam circulation conduits 21 and 22 are provided for this purpose. Conduit 22 isprovided with a drop-leg 23 for condensate pickup.

The surface 30 of heater roll 20 is coated with a high temperature polymer plastic such as Teflon to prevent subsequent sticking of the polymer web coating to the heater roll surface 30.

Heater roll 20 is mounted for rotation about the axis thereof. Rotary power for driving it may be by transmission links, not shown, from the corrugator roll drive motor 14 or directly from an independent drive motor 24.

Mounted by radius arms 25 and 26, respectively, are wrap control rolls 27 and 28. Radius arms 26 also carry a wrap control roll 29.

Outer and inner wrap control units respective to radius arms 25 and 26 are selectively positionable about the heater roll axis between the maximum wrap position illustrated in FIG. 1 with solid lines and minimum wrap position illustrated by broken lines.

Angle $\alpha$ designates the included angle about the axis of roll 20 between the maximum and minimum wrap positions for the outer wrap control roll 27.

Angle $\beta$ designates the included angle between maximum and minimum wrap positions of the inner wrap control roll 28.

The maximum and minimum wrap positions of inner wrap control roll 28 are determined by the maximum and minimum lengths of time required by the liner L in contact with the surface 30 of roll 20 to plasticize the polymer surface laminae of liner L contiguous with the roll surface 30. Such time periods will, of course, vary with the rotational speed of the roll 20 and the inlet steam temperature.

The maximum and minimum wrap positions of outer wrap control roll 27 are dependent first, on the maximu1m and minimum positions of inner roll 28 and second, on the approach path of web L from a supply reel not shown. In any case, it is necessary to control the routing of the web L over the entire positionment range of inner wrap control roll 28 so that no interference may occur.

Pursuant to these criteria, a fixed ratio between angles $\alpha$ and $\beta$ may be determined and the two wrap control units positively coordinated by suitable power transmission links such as sprockets 41 and 42.

Sprocket 41 is non-rotatively secured to radius arm 25 and sprocket 42 is secured to radius arm 26. Roller chains 43 and 44 transmit control movement from respective driver sprockets 45 and 46. Both driver sprockets are non-rotatively secured to the output shaft 48 of wrap control motor 47. the desired ratio between angles $\alpha$ and $\beta$ relative to rotation of the common power shaft from motor 47.

In operation, the degree of wrap contact between the liner web L and heater roll surface 30 is manually determined and set pursuant to a multiplicity of immediately relevant criteria. Accordingly, the wrap control motor is manually regulated by a polarity reversing switch 50, the closure of which determines the direction of motor 47 rotation. Switch 50 is held closed by the operator until the inner wrap control roll 28 is driven to the desired location about the heater roll circumference.

Simultaneous with the setting of the wrap control rolls, driver sprocket 51, non-rotatively secured to motor shaft 48, drives a speed control follower sprocket 53 via transmission chain 52. The follower sprocket 53 and conductive stylus 55 are non-rotatively secured to follower shaft 54. The distal end of stylus 55 contacts with the resistance winding 56 of a primary speed control rheostat 57. In circuit with the primary speed control winding 56 across a reference power source R are two temperature trimming rheostats 61*a* and 61*b*. Both trimming rheostats 61 have matched resistance windings 62*a* and 62*b*. Each trim resistance 62 provides a magnitude of resistance in the speed control circuit which is selected as a percentage of primary control resistance 56, 20% for example. Since the trim rheostats 61 are connected for opposite-hand operation on respective sides of the primary rheostat 57, the total resistive load across the reference power source R remains constant. Any magnitude of resistance added to the total circuit by trim rheostat 61*b*, resistance of the same magnitude is reduced by rheostat 61*a*.

The contact styli of trim rheostats 61 are simultaneously driven by actuator 63 which responds, proportionally, to signals from a temperature sensor 64.

The rotational speed of the main drive motor 24 is controlled conventionally by a relative voltage motor control device 70 which regulates the supply of power from a convenient generation source G. Basically, power supply and hence, responsive speed, is regulated as a percentage of a maximuum. Accordingly, motor controller 70 is provided by conduits with a constant reference voltage across source R. For speed regulation comparison, stylus conduit 58 provides a variable voltage derived across the resistances 62*a* and 56*a*. The speed of motor 24, therefore, becomes a percentage of conduit 58 voltage as compared to the maximum available voltage across conduits 65 and 66.

From the foregoing description, it may now be understood that as the operator sets the position of the wrap control roll 27 and 28 by a functioning of the polarity reversing switch 50, resistance in the primary speed control rheostat 57 between the reference power source R and the stylus 55 are determined accordingly. Subject to the trim resistance of rheostat 61*b*, the resulting voltage in stylus conduit 58 determines the running speed of motor 24.

Temperature sensor 64 is manually set to sensitivity of the desired web L temperature. Should the actual temperature of the web rise above the desired temperature the actuator 63 will be driven in one direction by a displacement mangitude proportional to the difference between the desired and actual temperatures. The actuator 63 displacement will consequently increase the voltage drop across resistance 62*b* but reduce the drop across resistance 62*a*. Consequently, the voltage at stylus conduit 58 is increased but the total drop across reference source R is unchanged. Because of the increased voltage in conduit 58, the proportion thereof to the total reference conduits 65 and 66 is increased the speed of motor 24 proportionately. Such increased speed reduces the residence time of web L against the heater roll surface 30 thereby reducing the web temperature at the point of temperature sensor 64.

Collectively, the present invention operates as follows. A web of corrugating medium M is received from a supply reel, not shown, and routed into the meshing nip between corrugating rolls 11 and 12. Simultaneously, heat is conductively transferred to the medium M from the hot water source flowing within rolls 11 and 12.

Subsequent to forming, the corrugated continuum of medium M is maintained in contiguous contact with the heater roll 11 into the nip with fusion roll 14 where the plasticized surface of liner web L is pressed into bonding contact with the corrugated flute crests of medium M.

Intimate surface contact between the medium M and the roll 11 is continued into the nip with the pressure roll 13 where, under the nip pressure, sufficient heat is withdrawn from the bonded joint between the flute crests of medium M and the liner L to set the joint. Thereafter, the integrated unit of webs M and L constituting single-face board B is withdrawn from the single-facing unit 10 for further processing.

Prior to entry into the fusion nip, liner web L is drawn from a supply reel, not shown, and routed over the outer wrap control roller 27 and around the inner wrap control roller 28. Regardless of the degree of wrap contact with heater roll surface 30 desired, liner web L will always approach the surface 30 at the same angle of tangency, relative to the inner wrap control roll 28.

Depending on the plasticizing temperature of the particular surface laminae on the web L, 210° F (98° C) for a one mill (25.4$\mu$ M) thickness of corona treated polyethylene, for example, and the present steam temperature circulated within heater roll 20, inner wrap control roll 28 is manually set at a desired position around the heater roll 20 circumference.

If corona treatment, as described in the July, 1970 Paper, Film and Foil Converter article by A.L. James, is not used, the plasticizing temperature of the laminae will be significantly increased. In the present example, a non-corona treated lamina plasticizing temperature will be in the order of 230° F (110° C).

Known properties of the plastic laminae and running experience will determine the exact temperature range that is to be monitored by the thermocouple 50 control which, in the given example, will be 208° to 212° F (97.8° to 100° C). The desired condition of the plastic is the lowest temperature to yield a tacky, soft result. Higher temperature induce an out-gassing of the substrate paper contained moisture in the form of steamso as to leave what is known as pin holes in the plastic coating continuity. Such pin holing permits the subsequent absorption of moisture by the paper substrate which dramatically reduces wet-strength of the corrugated board product.

Having selected a set position for the inner wrap control roller 28, speed control follower rheostat 57 sets a corresponding, previously calibrated, speed for both, the corrugating rolls 11, 12 and the heater roll 20. Should the resulting speed fail to yield the desired temperature to the bonding face of liner web L, trim rheostats 61*a*, 61*b*, responsive to the temperature sensor 64, will further adjust and continuously maintain the speed to the desired end.

The preferred embodiment of my invention being fully described herein,

I claim:

1. In an apparatus for bonding a first web to a second, corrugated web comprising a pair of fluted surface corrugating cylinders rotatively disposed in a flute meshing nip relationship, a first web heating drum mounted for rotation about a cylindrical axis thereof, and web wrap control means selectively positionable about said heating drum, said corrugating cylinders and said heating drum having heat sources conducted therethrough, the improvement comprising:

A. A rotatable fusion roll positioned in nip relationship with said heating drum and flute crests of one of said corugating cylinders;

B. Said wrap control means comprising inner and outer wrap control rolls, each being selectively positionable about respective arcs relative to said cylindrical axis, and C. Rotational power transmission means coupled to said wrap control rolls with a rotational ratio proportional to a ratio between said respective arcs whereby the arcuate positionment of said outer wrap control roll is coordinated with the arcuate placement of said inner wrap control roll.

2. In an apparatus as described by claim 1 wherein the heat sources respective to said corrugating cylinders are liquid flow streams of heated water.

3. In an apparatus as described by claim 2 wherein the heat source respective to said heating drum is a vapor flow stream of steam.

4. In an apparatus as described by claim 3 wherein said fusion roll is provided with a heat source flow conduit therein.

5. In an apparatus as described by claim 3 wherein a pressure roll is positioned in nip relationship with said flute crests of said one corrugating roll, said pressure roll having a fluid heat sink medium conducted therethrough.

6. In an apparatus as described by claim 1 wherein temperature sensing means is positioned adjacent said first web, between said nips respective to said fusion roll with said one corrugating roll and said heater drum, to detect the temperature of said first web and generate a first electrical signal proportional to said temperature.

7. In an apparatus as described by claim 6 comprising primary speed regulation means that is adjusted as a function of the arcuate positionment of said wrap control means for controlling the rotational speed of heating drum and corrugating roll drive means, and speed trim adjusting means responsive to said first signal to further control the rotational speed of said drive means.

8. Apparatus as described by claim 7 wherein said primary speed regulation means comprises first variable resistance means in a motor speed control circuit for said drive means, said variable resistance being adjusted by said power transmission means.

9. Apparatus as described by claim 8 wherein said speed trim adjusting means comprises second variable resistance means in said motor speed control circuit and actuator means responsive to said first signal to adjust said second variable resistance means.

10. In an apparatus for bonding a first web to a second, corrugating web comprising a pair of fluted surface corrugating cylinders rotatively disposed in a flute meshing nip relationship, a first web heating drum mounted for rotation about a cylindrical axis thereof and web wrap control means selectively positionable about said heating drum, said corrugating cylinders and said heating drum having rotational drive means and heat sources conducted therethrough, the improvement comprising:

A. A rotatable fusion roll positioned in nip relationship with said heating drum and flute crests of one of said corrugating cylinders;

B. Temperature sensing means positioned adjacent said first web, between said nips respective to said fusion roll with said one corrugating roll and said heating drum, to detect the temperature of said first web and generate a first electrical signal proportional to said temperature;

C. Primary speed control means for controlling the rotational speed of said drive means as a function of said wrap control means positionment; and, D. Secondary speed control means for further controlling the rotational speed of said drive means as a function of said first signal.

11. Apparatus as described by claim 10, wherein said heating drum heat source comprises steam flow conducted through a chamber within said heating drum and corrugating cylinder heat source comprises heated water conducted through flow chambers therewithin.

12. Apparatus as described by claim 11 wherein a pressure roll is positioned in nip relationship with said flute crests of said one corrugating cylinder said pressure roll having a fluid heat sink medium conducted therethrough.

13. Apparatus as described by claim 10 wherein said wrap control means comprise first and second wrap control rolls disposed axially parallel with said heating drum between respective pairs of radius arms, said first wrap control roll being positioned more proximate of the surface of said heating drum than said second wrap control roll, and rotational power and transmission means coupled to said radius arms to coordinate the arcuate positionment of said wrap control rolls about the cylindrical axis of said heating drum.

14. A method of fabricating corrugated board comprising a corrguated medium web and a liner web comprising the steps of:

A. Coating at least one face of said liner web with a thin laminae of polymer plastic material.

B. Contacting said coated face of said liner web against the surface of a rotating heater drum for a time period sufficient to soften said plastic material to a tacky consistency.

C. Peeling said liner web from the surface of said heater drum at a first nip of a treated fusion roll with said heater drum;

D. Fusing the coated surface of said liner web with the crests of corrugation flutes formed in said medium web in a second nip of said fusion roll with a rotating corrugating roll; and E. Cooling the fused combination of said liner web and said medium web in a nip between a chilled pressure roll and said corrugating roll.

15. A method of fabricating corrugated board as described by claim 14 wherein the temperature of said coated surface is measured between said heater drum and said corrugating roll, a control signal being generated as a function of said temperature measurement and the speed of said board fabrication being regulated as a function of said control signal.

16. In an apparatus for bonding a liner web to corrugation crests of a medium web, said liner web comprising a lamination of polymer plastic film to at least one surface of a paperboard web, said apparatus comprising:

A. Rotational drive means for rotating a cooperating pair of medium web corrugating cylinders;

B. Heating means for transmitting heat to the plastic film laminae of said liner web;

C. Rotatable heated fusion roll means positioned in nip relationship with one of said corrugating cylinders for guiding said liner web into a fusion nip with the corrugation crests of said medium web;

D. Temperature sensing means positioned between said heating means and said fusion nip for sensing the temperature of said plastic film laminae and emitting a temperature signal proportional thereto; and E. Speed control means responsive to said temperature signal for regulating the rotational speed of said drive means to maintain the temperature of said plastic film laminae within a desired temperature range.

17. A method for fabricating corrugated board comprising a corrugated medium web and a liner web, said method comprising the steps of:

A. Coating at least one surface of said liner web with a thin laminae of polymer plastic material;

B. Heating said polymer plastic laminate to a tacky consistency;

C. Fusing the heated plastic surface of said liner web to the crests of corrugation flutes in said medium web at a nip between a heated fusion roll and a medium web corrugating roll;

D. Sensing the temperature of said heated plastic surface immediately prior to said nip;

E. Comparing the temperature of said heated plastic surface to a desired temperature range; and, F. Regulating the speed of said corrugating roll in response to said temperature comparison.

* * * * *

UNITED STATES PATENT OFFICE

CERTIFICATE OF CORRECTION

PATENT NO. : 4,038,122

DATED : July 26, 1977

INVENTOR(S) : John DeLigt

It is certified that error appears in the above-identified patent and that said Letters Patent are hereby corrected as shown below:

Column 1, line 11, following "mer", insert --plastic--; line 51, following "production", insert --problems--. Column 3, line 35, following "OF", insert --THE--. Column 4, line 9, "is provided" should be written as two words; line 22, following "a", insert --third--; line 26, following "and", insert --a--; lines 43-44, correct the spelling of "maximum"; line 59, following "47." insert a new paragraph and line as follows: --The ratios between sprockets 41-45 and 42-46 are selected to yield--. Column 5, line 36, "62a and 56a" should be --62b and 56--; line 45, the verb "are" should be --is--; line 53, correct the spelling of "magnitude"; line 61, following "total", insert --across--. Column 6, line 46, "steam so" should be written as two words. Column 8, line 15 (Claim 11, line 3), following "and", insert --said--; line 43 (Claim 14, line 11), "treated" should be --heated--. Column 9, line 13 (Claim 17, line 1), "for" should be --of--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*